US005433329A

United States Patent [19]

Weinstein

[11] Patent Number: 5,433,329

[45] Date of Patent: Jul. 18, 1995

[54] CHILD-RESISTANT CAP WITH INDEPENDENT OPEN AND CLOSE RATCHET SETS

[75] Inventor: Jack Weinstein, Manchester Township, Ocean County, N.J.

[73] Assignee: Primary Delivery Systems, Inc., Easton, Pa.

[21] Appl. No.: 311,539

[22] Filed: Sep. 23, 1994

[51] Int. Cl.[6] ..... B65D 55/02

[52] U.S. Cl. ..... 215/220; 215/219

[58] Field of Search ..... 215/217, 219, 220, 223

[56] References Cited

U.S. PATENT DOCUMENTS

| | | | |
|---|---|---|---|
| 3,705,662 | 12/1972 | Gach . | |
| 3,797,688 | 3/1974 | Porcelli et al. | 215/220 |
| 3,893,582 | 7/1975 | Kowalik . | |
| 4,165,813 | 8/1979 | Babiol | 215/220 |
| 4,319,690 | 3/1982 | Birrell et al. . | |
| 4,442,945 | 4/1984 | Sandhaus . | |
| 4,500,005 | 2/1985 | Forrester . | |
| 4,646,926 | 3/1987 | Agbay et al. . | |
| 4,832,218 | 5/1989 | Gilbilisco | 215/220 |
| 5,115,929 | 5/1992 | Buono | 215/220 |

FOREIGN PATENT DOCUMENTS

| | | | |
|---|---|---|---|
| 2543453 | 4/1976 | Germany | 215/220 |

*Primary Examiner*—Stephen P. Garbe
*Assistant Examiner*—Stephen Cronin
*Attorney, Agent, or Firm*—Kenneth P. Glynn

[57] ABSTRACT

A child-resistant cap with independent open and close ratchet sets. It includes an inner cap having a top and side walls and having inside surfaces and outside surfaces and an open bottom, and structure for attachment to a container. It also has a flanged base extending outwardly from its side walls, with the flanged base having one-way ratchet members thereon for engagement with an outer collar for locked rotation of an outer collar with the inner cap in a circular, first direction. It also has ratchets located on the outside surface of the top for engagement with an outer cap for rotation of an outer cap with the inner cap in a circular, second direction opposite from said first direction. There is an outer cap having a top and side walls and an open bottom and having inner surfaces and outer surfaces. It is rotatably attached to the inner cap and has ratchets on its inside surface of its top for engagement with the inner cap. There is also an outer collar rotatably mounted about the inner cap and the outer cap which has ratchets thereon for engagement with the ratchets located on the base flange of the inner cap.

5 Claims, 1 Drawing Sheet

CHILD-RESISTANT CAP WITH INDEPENDENT OPEN AND CLOSE RATCHET SETS

BACKGROUND OF THE INVENTION

1. Field of the Invention

The present invention is directed to child-resistant caps for containers for which there is a need to inhibit or prevent children from opening them. The caps of the present invention have inner caps and outercaps with two separate sets of ratchets which operate independently of one another, one set for opening and one set for closing the caps.

2. Information Disclosure Statement

There are literally thousands of prior art patents covering child-resistant features for container caps, covers and lids. The following prior art is of particular interest to the present invention:

U.S. Pat. No. 3,705,662 issued to Peter P. Gach describes a closure for a medical bottle or the like which requires a special operation to open. The closure is placed on, for example, a medicine bottle having a threaded neck. The closure includes an inner cap having threads adapted to engage with the threaded bottle neck. A plurality of vertical ribs are provided on the exterior sidewall of the inner cap. An overcap is positioned over the inner cap. The overcap includes at least one flexible portion movable toward the inner cap ribs. A series of mating ribs are provided on the flexible portion adjacent the inner cap ribs. To remove the closure, the flexible portion is depressed causing the adjacent ribs to mate. Rotation of the overcap, after such depression of the flexible portion, transfers force to the inner cap and the closure can be removed from the bottle.

U.S. Pat. No. 3,893,582 issued to John J. Kowalik describes a childproof closure comprising a cap which may be threaded or snapped onto a complementary finish on a neck of a container, the cap having a flexible slotted lower skirt portion provided with inwardly projecting lugs which are adapted to snap under an annular shoulder at the lower end of the finish, the lugs lock beneath the shoulder when the cap is closed and snap out from under the shoulder when the cap is unscrewed or lifted. An auxiliary locking ring is movable and locked over the slotted skirt portion to prevent the lugs from releasing and is movable off the slotted portion to permit release of the lugs and opening of the container.

U.S. Pat. No. 4,319,690 issued to Stewart H. Birrell, et al. describes a safety closure and container assembly including a container and a closure comprising outer and inner caps which may be attached to the container by conventional capping machines. In first, second, third and fourth embodiments of the invention, the inner cap is formed with a circular dome-shaped top panel with a skirt portion projecting axially therefrom. The projecting skirt portion is threaded on its interior surface for engagement with a conventionally threaded container finish. A plurality of upwardly extending and spaced apart drive members are integrally molded with the periphery of the top panel. A plurality of ramped ratchet lugs also extend upwardly from the upper surface of the top panel. The outer cap has a circular end wall with an axially projecting second skirt portion.

U.S. Pat. No. 4,442,945 issued to Jeffrey Sandhaus describes a safety closure of the type having a unitary construction with a closed top from which an interiorly threaded skirt depends and a container having an exteriorly threaded neck on which the closure is mounted in sealing relationship. The safety closure has one or more locking members formed integrally therewith which are movable under the action of actuating apparatus between a non-locking position and a locking position in which the locking members engage appropriate corresponding locking elements provided on the neck of the container. The actuating apparatus is constituted by the top of the closure which has a dish-like configuration formed such that the application of a sufficient finger pressure on the top will result in the movement of the locking members from the locking to the non-locking position.

U.S. Pat. No. 4,500,005 issued to Jerry Forrester describes a tamper-evident cap assembly for a container with an externally screw-threaded top has an inner cap having an annular wall and an open lower end, the annular wall having an internal screw-thread to enable the inner cap to be screwed onto the top of the container by clockwise movement of the inner cap relative to the container. An outer cap has an annular wall, a closed upper end and an open lower end, the outer cap being fitted over the inner cap and retained in assembly with the inner cap. The annular walls of the inner and outer caps have mutually-engaging screw-threads to cause initial anticlockwise turning movement of the outer cap relative to the inner cap. The inner and outer caps have cooperating ratchets to cause clockwise movement of the outer cap to be transmitted to the inner cap while permitting anticlockwise movement of the outer cap relative to the inner cap. The closed end of the outer cap has a window and the inner cap has an insignia which is not visible in the window when the outer cap is in an initial relatively clockwise position relative to the inner cap and which is visible when the outer cap has been turned in an initial anticlockwise movement relative to the inner cap.

U.S. Pat. No. 4,646,926 issued to Albert J. Agbay, et al. describes safety closures resistant to (and evidencing) tampering comprising a snap cap or screw cap, a rotary safety ring, and a tear tab attached to the neck of the container, said closure requiring that the tear tab be removed before the safety ring can be lowered; the safety ring must be aligned with the cap in one angular position and pushed downwardly away from the cap before the cap can be removed from the container. These safety closures may include a tear pin, attached to the cap and to the ring, which must be broken before the cap can be removed from the container; the tear pin may be in addition to, or an alternative for, the tear tab. The tear pin and tear tab are made to be removable. This invention describes a tamper resistant and tamper evident closure comprising a cap having a depending annular flange with a slot therein, and an outwardly directed wing protruding through said slot; the cap cannot be removed without causing the cap to shear off the outwardly directed wing, which is made to be removable. This invention describes a tamper resistant and tamper evident closure comprising a screw cap having an engaging surface located next to a projecting member attached to the neck of the container so that the engaging surface will always shear off the projecting member, which is made to be removable, when the screw cap is first removed from the container.

Notwithstanding the prior art, it is believed that the present invention is neither taught nor rendered obvious.

SUMMARY OF THE INVENTION

The present invention is a child-resistant cap with independent open and close ratchet sets. It includes an inner cap having a top and side walls and having inside surfaces and outside surfaces and an open bottom, and means for attachment to a container. It also has a flanged base extending outwardly from its side walls, with the flanged base having one-way ratchet members thereon for engagement with an outer collar for locked rotation of an outer collar with the inner cap in a circular, first direction. It also has ratchets located on the outside surface of the top for engagement with an outer cap for rotation of an outer cap with the inner cap in a circular, second direction opposite from said first direction. There is an outer cap having a top and side walls and an open bottom and having inner surfaces and outer surfaces. It is rotatably attached to the inner cap and has ratchets on its inside surface of its top for engagement with the inner cap. There is also an outer collar rotatably mounted about the inner cap and the outer cap which has ratchets thereon for engagement with the ratchets located on the base flange of the inner cap. When the outer cap is pressed downwardly and its ratchets engage with the ratchets located on the top of the inner cap in the second direction, such rotation causes engagement of the inner ap so as to permit rotation of the inner cap and removal of the inner cap from a container to which it may be attached, i.e., it permits opening. When the outer collar is rotated in the first direction, such rotation causes engagement of the outer collar with the inner cap so as to permit rotation of the inner cap for attachment thereof to a container. In this invention, the outer collar ratchets and the inner cap ratchets are engageable separately and independently from one another.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

Obviously, numerous modifications and variations of the present invention are possible in light of the above teachings. It is therefore understood that within the scope of the appended claims, the invention may be practiced otherwise than as specifically described herein.

The present invention is directed to a child-resistant cap with independent and open and close ratchet sets wherein one set of ratchets is located on the top of the inner cap and the other set of ratchets is located on the side of the inner cap, with corresponding ratchets on the inside of an outer cap and on the inside of an outer ring. The present invention child-resistant cap represents a substantial improvement over existing technology due to the fact that, with the present invention device, a user need not press down to close. There is immediate and total on torque for closing due to the interaction of the outer collar with the closing ratchets on the outer collar and on the outside of the inner cap.

Figure 1:
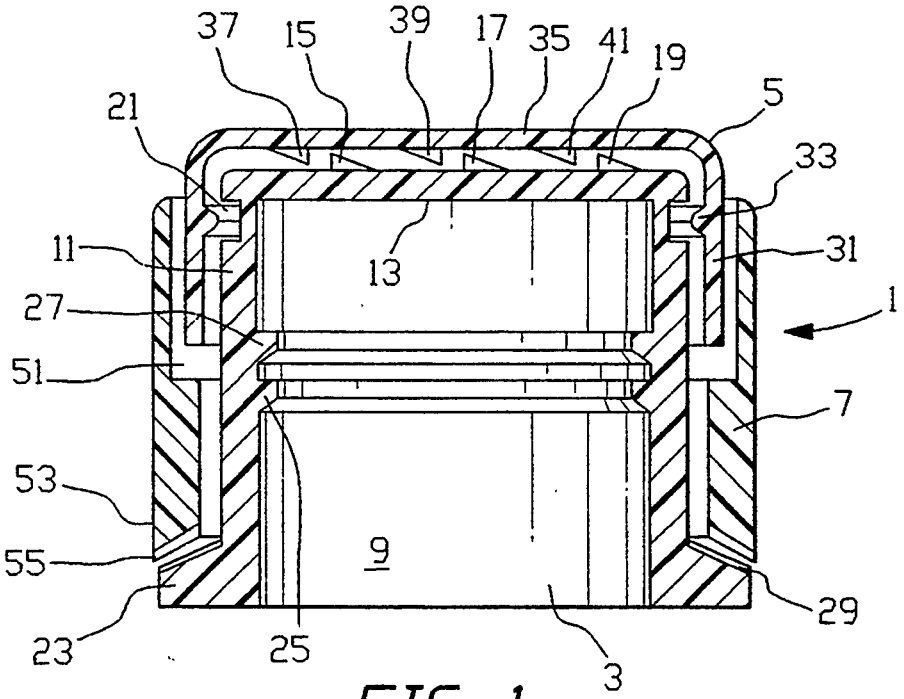
FIG. 1 shows a cut view of a present invention child-resistant cap.

Referring now to FIG. 1, there is shown a front cut view of present invention child-resistant cap 1. It includes an inner cap 3, an outer cap 5 and an outer collar 7. Inner cap 3 includes an open bottom 9 as well as a circular sidewall 11 and a top 13. Located on the outside surface of top 13 are a series of ratchets as exemplified by ratchets 15, 17 and 19. These are used in conjunction with corresponding ratchets such as ratchets 37, 39 and 41 located on the inside surface of bottom 35 of outer cap 5.

Inner cap 3 has means for attachment to a container and, in this case, such means is represented by threads 25 and 27. Additionally, there is a circular cut-out 21 for a rotational guide track which has a corresponding protrusion 33 located on the inside surface of wall 31 of outer cap 5. Circular cut-out 21 and protrusion 33 work together to permanently, rotatably affix outer cap 5 to inner cap 3, as well as to maintain outer collar 7 in place. In other words, the three components are manufactured separately, collar 7 is placed over inner cap 3 and then outer cap 5 is placed over the top of inner cap so that it fits over it and wall 31 fits between inner cap 3 and outer collar 7, thereby also rotatably fixing outer collar 7 with respect to inner cap 3 and outer cap 5. The ratchets 15, 17 and 19 and other corresponding ratchets not shown, nest with ratchets 37, 39 and 41 and their counterparts which are not shown, so as to permit a user to press down and rotate present invention cap in a single direction, e.g., counterclockwise, for opening. Outer collar 7 has a cut-out 51 so as to permit space between it and inner cap 3 for wall 31 of outer cap 5, as shown. Additionally, it has a bottom edge 53 with ratchets such as ratchet 55. Correspondingly, inner cap 3 has a protrusion or ledge 23 with ratchets such as ratchet 29. When a user places cap 1 onto a container, the user will inherently or by instruction on a cap or otherwise, hold outer collar 7 and rotate same. Due to the downward rotation, there will be an inherent and immediate interlocking of the ratchets on outer collar 7 and on the protrusion 23 of inner cap 3 so that cap 1 may be screwed onto a container without the need for significant down pressure which is required with the standard inner cap/-outer cap ratchet system in use today.

Figure 2:
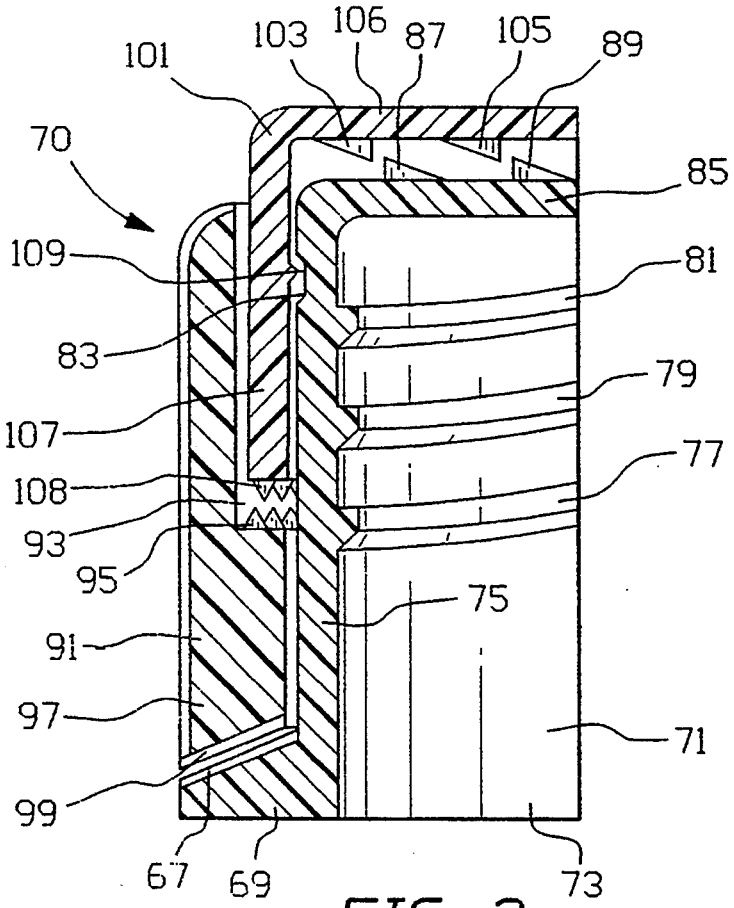
FIG. 2 illustrates a cut quarter front view of another embodiment of the present invention child-resistant cap.

FIG. 2 shows a quarter cut front view of an alternative present invention cap 70. Here, there is an inner cap 71, an outer cap 101 and an outer collar 97. Inner cap 71 includes an open bottom 73, threads such as threads 77, 79 and 81 and has a sidewall 75 and a top 85. Top 85 includes opening ratchets such as ratchets 87 and 89 and includes a cut-out track 83. While this track is shown to be indented and corresponding protrusion 109 extends outwardly from the inner wall of outer cap 101, this could be reversed without exceeding the scope of the present invention. In other words, inner cap 71 could have a protrusion with outer cap 101 having a track. Other equivalents could be used. For example, collar 91 could have a protrusion or recess on its inside wall with the corresponding recess or protrusion on the outside of wall 75 of inner cap 71 and then outer collar 91 could be similarly connected to the outside wall of outer cap 101. Other mechanisms for maintaining the devices in an affixed position so as to be rotatable relative to one another without using the exact arrangements shown in the figures and without exceeding the scope of the present invention.

Outer cap 101 has side wall 107 and has a top 106 with ratchets such as ratchets 103 and 105, as shown. These ratchets work in conjunction with ratchets 87 and 89 for opening a container to which present invention cap 70 may be attached. Outer collar 91 includes cut-out 93 similar to cut-out 51 of collar 53 described in conjunction with FIG. 1 above. However, in this case, there are a series of teeth such as is represented by tooth 95 and these teeth act to interact with teeth, such as tooth 108 on the bottom of wall 107 of outer cap 101 when cap 70 is being screwed onto a container so as to enhance its functionality when a user is holding both the outer cap 101 and outer collar 91 or, one or the other. Additionally, outer collar 91 includes a bottom 97 with ratchets such as ratchet 99 and inner cap 71 includes a protrusion or ledge 69 with ratchets such as ratchet 67. These ratchets on ledge 69 and bottom 97 interact with one another to screw on or close cap 70 with respect to a container to which it may be attachable.

What is claimed is:

1. A child-resistant cap with independent open and close ratchet sets, which comprises:

(a) an inner cap having a top and side walls and having inside surfaces and outside surfaces and an open bottom, and means for attachment to a container, said inner cap having a flanged base extending outwardly from its side walls, said flanged base having one-way ratchet members thereon for engagement with an outer collar for locked rotation of said outer collar and said inner cap in a circular, first direction, and having ratchets located on the outside surface of said top of said inner cap for engagement with an outer cap for rotation of said outer cap and said inner cap, in a circular second direction opposite from said first direction;

(b) said outer cap having a top and side walls and an open bottom and having inner surfaces and outer surfaces, said outer cap being rotatably attached to said inner cap and having ratchets on said inside surface of said top of said outer cap for engagement with said inner cap; and, (c) said outer collar rotatably mounted about said inner cap and said outer cap and having ratchets thereon for engagement with said ratchets located on said base flange of said inner cap;

wherein when said outer cap is pressed downwardly and its ratchets engage with said ratchets located on the top of said inner cap in said second direction, such rotation causes engagement of said inner cap so as to permit rotation of said inner cap and removal of said inner cap from a container to which it may be attached, and when said outer collar is rotated in such first direction, such rotation causes engagement of said outer collar with said inner cap so as to permit rotation of said inner cap for attachment thereof to a container and further wherein said outer collar ratchets and said inner cap ratchets are engageable separately and independently from one another.

2. The child-resistant cap with independent open and close ratchet sets of claim 1 wherein said base flange has its ratchets biased upwardly and said outer collar has a bottom surface and said outer collar ratchets are located on said bottom surface.

3. The child-resistant cap with independent open and close ratchet sets of claim 1 wherein said outer collar and said outer cap having means for engaging one another when said outer cap is pushed downwardly.

4. The child-resistant cap with independent open and close ratchet sets of claim 2 wherein said outer collar and said outer cap having means for engaging one another when said outer cap is pushed downwardly.

5. The child-resistant cap with independent open and close ratchet sets of claim 1 wherein said attachment means for attachment of said inner cap to a container is threading.

* * * * *